US005690264A

United States Patent [19]

Distefano et al.

[11] Patent Number: 5,690,264

[45] Date of Patent: Nov. 25, 1997

[54] APPARATUS AND METHOD FOR SELF-ALIGNING CONTACTING SURFACES

[75] Inventors: Joseph Distefano, Hilton; Vladimir A. Garris, Rochester; Brian Douglas Hauss, Spencerport; Michael Alexander Kubiak, Rochester, all of N.Y.

[73] Assignee: Eastman Kodak Company, Rochester, N.Y.

[21] Appl. No.: 608,887

[22] Filed: Feb. 29, 1996

[51] Int. Cl.[6] ..... B65H 20/00; B65H 20/02

[52] U.S. Cl. ..... 226/187; 226/194

[58] Field of Search ..... 226/183, 186, 226/187, 190, 194

[56] References Cited

U.S. PATENT DOCUMENTS

| | | | |
|---|---|---|---|
| 329,191 | 10/1885 | McMurtrie . | |
| 369,126 | 8/1887 | Ratekin . | |
| 462,310 | 11/1891 | Gardner . | |
| 815,511 | 3/1906 | Cole . | |
| 1,185,761 | 6/1916 | Bewsic . | |
| 1,910,387 | 5/1933 | Hahn . | |
| 2,555,790 | 6/1951 | Emery . | |
| 3,093,284 | 6/1963 | Mullin | 226/186 |
| 3,443,295 | 5/1969 | Denoyer et al. . | |
| 3,559,262 | 2/1971 | Glenn et al. . | |
| 3,604,087 | 9/1971 | Beck . | |
| 3,738,896 | 6/1973 | Sonnichsen . | |
| 4,049,140 | 9/1977 | Roose . | |
| 4,127,066 | 11/1978 | Sharkey . | |
| 4,171,655 | 10/1979 | Voorhees . | |
| 4,366,752 | 1/1983 | Koski . | |
| 4,372,247 | 2/1983 | Calabrese . | |
| 4,529,141 | 7/1985 | McClenathan . | |
| 4,759,485 | 7/1988 | Braun et al. | 226/186 |
| 4,776,527 | 10/1988 | Prowant . | |
| 4,788,911 | 12/1988 | Bishop et al. . | |
| 5,540,373 | 7/1996 | Sugizaki et al. | 226/186 |

*Primary Examiner*—Daniel P. Stodola
*Assistant Examiner*—Matthew A. Kaness
*Attorney, Agent, or Firm*—Clyde E. Bailey, Sr.; Charles E. Snee, III

[57] ABSTRACT

An apparatus and method for continuously self aligning a first surface with a second roller has an adjustable support member for the first surface which produces movements of the first roller that corresponds to movements of the second roller. The adjustable support member supporting the first roller uses a plurality of bearings, preferably thrust bearings, arranged on the frame supporting the first roller which alignable controls the movements of the first roller in contact with the second roller.

14 Claims, 4 Drawing Sheets

APPARATUS AND METHOD FOR SELF-ALIGNING CONTACTING SURFACES

DESCRIPTION

1. Technical Field

The invention generally concerns an apparatus and method for self-aligning surfaces in proximate rotating contact with one another. More particularly, the invention relates to an apparatus and method for self-aligning a nip roller in proximate rotating contact with a web conveyance roller, core or spool, or winding roll, of the type used in web converting machines, so that the surfaces maintain alignment and proximate rotating contact despite surface imperfections, such as non-concentricity and web caliber variations and the like.

2. Background of the Invention

Nip rollers are frequently used in wide web converting machinery in a variety of applications including automatic roll start processes, lay-on or builder rollers, and conveyance roller drives. A nip is defined as the region of contact created by two rotating cylindrical bodies which are in forced surface contact with each other. A roller is defined as a machined, generally cylindrical article of manufacture normally mounted rotatably about its central axis and is typically used to support and convey a web, such as photographic paper or film. Nip rollers are commonly mounted into pivot frames, which are used as a means to mechanically support the roller and engage the roller into forced contact with a mating rotating body such as a core or spool, winding roll, or conveyance roller, depending upon the application.

Conventional pivot frame designs may include: (1) a central pivot shaft and bearing arrangement to provide a mechanical connection between both ends of the pivot assembly and central axis of rotation; and (2) rigid pivot arms which extend radially from the central shaft and are in angular alignment with each other. Cross bars are generally added between the pivot arms to improve structural stiffness of the pivot frame and insure that flexure is minimized and accurate alignment between the arms is maintained. Contact force between the mating rotating bodies is generated using air or hydraulic cylinders, electric drives, torsion springs, or any other well known mechanical device, which is mechanically coupled to the pivot arms at a fixed radial distance from the central axis of rotation using a clevis-type mounting arrangement.

Skilled artisans in the art of web conveyance will appreciate that a rigid pivot frame design does not allow freedom of motion or self-alignment between ends of the nip roller. As a result, rigid pivot frames prevent the roller from compensating for non-ideal geometry of the mating cylindrical surface, such as non-concentricity, also known as runout, and non-cylindricity or taper, which is a difference in diameter between ends of the rotating body. Moreover, the rigid pivot frame design requires close mechanical tolerances be maintained between the central axes and surfaces of the rotating bodies in forced intimate contact with each other to insure uniform contact force is applied.

Other inherent shortcomings of the rigid pivot frame used in web convening machinery are manifest, for instance, during the roll start process. Roll start (or roll transfer) is defined as the process of starting winding of new rolls at the winder to allow continuous operation of web machines. In automated roll start processes, a nip roller is normally used to apply force between the web and core or spool, which has adhesive tape applied to the surface, to adhere a cut web edge and produce a new roll start. The nip roller can be soft or hard surfaced, depending upon the application, and have vacuum applied internally to pressurize the roller surface negatively to improve adhesion between the web and said roller surface.

Uniform contact between the nip roller and core is a critical variable in automated roll start processes. Lack of uniform contact or loss of contact during the roll start process can cause poor roll start quality or roll start failures which result in machine down time, material waste, and web line start-up expense. Cores and spools are normally not geometrically perfect and may have non-concentricity with respect to the central axis, also known as runout, and noncylindricity, which is a difference in diameter between ends. In addition, the non-concentricity at one core end may be out of angular alignment or out of phase with respect to the non-concentricity on the opposite core end creating a wobbling effect during core rotation. Thus, a nip roller mounted in a rigid pivot frame is severely limited in its ability to respond to non-concentric and non-cylindrical core geometry due to structural stiffness of the rigid mounting design.

Non-concentricity normally occurs at frequencies of one or more per revolution of the core and becomes more severe at higher line speeds. Non-concentricity which is out of phase will generate oscillations (wobbling) at frequencies greater than once per revolution of the core. Rigid pivot frames are generally designed with significant mass to insure that accurate alignment between ends of the roller with respect to each other and the central pivot shaft is maintained. Response of a rigid pivot frame to higher frequency perturbations, such as core runout, is limited by rotational inertia of the pivot frame, which is a function of the mass and frictional effects, or internal hysteresis in the mechanical components and actuating means. To maintain uniform web contact, a rigid pivot frame must change its direction of rotation at frequencies identical to the frequency of core oscillation but is limited in doing so due to rotational inertia and frictional effects. The result is non-uniform contact force and potential loss of contact, which can cause poor roll start quality, such as fold over, wrinkling, or creasing of the web on the core, and roll start failures by preventing the web from adhering to the core. Pre-taped cores are normally used in automated roll start processes to promote adhesion of the cut web edge to the core at line speed. Pressure sensitive adhesive tapes are generally used for this purpose and effectiveness of the tape in promoting adhesion with the web is strongly dependent on the contact force applied between the web and tape during transfer. Therefore, lack of uniform contact force will adversely affect adhesive forces generated between the web and core during the roll start process increasing potential for roll start failures.

Non-cylindricity or taper can also cause roll start quality problems and potential failures. The central axis of a nip roller mounted in a rigid pivot frame is fixed mechanically to the central axis of the mating rotating body, in this case, a core or spool. It is generally well known that a rigid pivot frame does not allow the nip roller to self-align to the surface of a core with non-uniform diameter and will result in higher contact force applied to the core end with greater diameter and less contact force applied to the core end with smaller diameter.

Non-uniform widthwise contact force will generate an axial driving force or tendency for the web to move axially along the roller surface and steer toward one edge increasing potential for creasing and wrinkling of the product at the core. For webs sensitive to core impressions, such as photographic film and paper products, roll start wrinkling and creasing can generate significant product waste.

Furthermore, in lay-on or builder roller applications, uniform contact force is necessary to insure consistent wound roll integrity is maintained throughout the winding roll diameter. A winding roll is defined as a web wound on itself and around a core forming a spirally arranged web package of cylindrical shape. A lay-on or builder roller applies a radial force to the outer periphery of the roll during winding to eliminate boundary layer air traveling with the web from becoming entrained between the laps, thus improving overall wound roll quality. To insure that the beneficial effects of the lay-on roller occur uniformly throughout the winding roll, uniform contact force must be applied to the surface of the roll as it builds during winding. Non-uniform contact force, or loss of contact in extreme cases, can create a wound roll defect predominantly with paper webs known as wash boarding, which consists of a series of axial ridges in the wound roll created by alternating hard and soft areas due to application of non-uniform contact force or bouncing during the winding process. Winding of webs with widthwise web thickness non-uniformity will result in the formation of a conical or tapered wound roll surface profile. The wound roll will have a greater diameter corresponding to the web edge with increased thickness and a smaller diameter on the opposite web edge. Hence, a rigid lay-on roller cannot accommodate the tapered wound roll profile and will result in non-uniform contact force being applied to each edge of the wound roll. This can generate wound roll shifting and web creasing which will become more severe as the wound roll diameter increases and the effect of widthwise caliper variation is magnified by additional winding roll laps.

Moreover, in conveyance nip roller drive applications, non-uniform widthwise contact force will increase potential for web creasing by generating axial driving forces along the axis of the rollers causing the web to steer toward one edge. It is common for wide webs to have thickness caliper variations across the web width with one edge having greater thickness than the opposite web edge. Use of a rigid pivot frame design will generate non-uniform nip roller contact force to occur across the web width due to the widthwise thickness non-uniformity. Increased contact force will be applied to the web edge of greater thickness and less contact force will be applied to the web edge of lesser thickness. In addition, web imperfections may occur due to excessive contact force applied to web materials sensitive to applied pressure, which will be higher on the web edge having greater thickness.

Therefore, a need persists for an apparatus and method that provides self alignment of rollers in proximate rotating contact thereby eliminating concerns associated with surface imperfections, such as core non-concentricity and web caliber variation, and enabling web conveyance at exceedingly higher production speeds.

SUMMARY OF THE INVENTION

It is, therefore, an object of the invention to provide an apparatus for self-aligning surfaces in proximate rotating contact.

It is another object of the present invention to provide an apparatus for minimizing effects of core imperfections and web caliber variations on nip roller contact force uniformity.

Another object of the invention is to provide a self-aligning roller assemblage that enables a supported first roller to rotatably contact a second roller and maintain proximate, rotating contact with the second roller.

Yet another object of the invention is to provide an aligning apparatus in web convening machines that is capable of maintaining uniform web contact by changing its direction of rotation at frequencies identical to the frequency of core oscillation.

It is a feature of the invention that an arrangement of mounting and bearing means are provided for structurally joining first and second frame members that enable a first rotating surface to move in response to movements of an aligned, proximately contacting second rotating surface thereby maintaining alignment and proximate rotating contact therebetween.

To accomplish these and other objects of the invention, there is provided, in one aspect of the invention, an apparatus for self-aligning a first surface in proximate contact with a second surface. A first frame member has a main portion and first and second opposite end portions extending from the main portion. Further, first and second elongated members, which are structurally connected to said first frame member, define a central axis which passes through the first end portion, the main portion and then the second end portion of said first frame member. The first and second end portions each are provided with a rotatable end mount which rotate about the central axis defined by the first and second elongated members. Moreover, a second frame member cooperatively mounted to the first frame member has second, opposite end portions for supporting the first surface. Bearing means are provided for supportedly mounting the first frame member to the second frame member. The beating means are arranged to provide continuous alignment by allowing the second frame member, which contains the first surface, freedom to rotate about a central pivot bearing. Bearing means, moreover, control the amount of rotational movement of the first surface by providing clearance between the inside diameter of the bore in the second frame and outside diameter of a cylindrical cushion, which is part of thrust bearings located between roughly the midpoint and end of first and second frames. The central pivot bearing provides a means of rolling friction which has minimal resistance to the angular rotation of the second frame, allowing it to rotate freely about the central pivot bearing which defines a central axis perpendicular to central axis of first surface. Therefore, geometric variations in the second surface, such as non-concentricity (runout) and non-cylindricity (taper), in proximate rotating contact with the first surface, will force the first surface, mounted in the second frame, to conform to the geometric variations of the second surface with minimal resistance.

In another aspect of the invention, a self-aligning roller assemblage comprises first and second frame members as described above. The second frame member which is mounted to the first frame member provides means for supporting a first roller, such as a nip roller. This roller supporting arrangement provides means for controlling the rotational movements of the first roller. Hence, in this aspect of the invention, a second roller positioned in alignable, proximate rotating contact with the first roller maintains it proximate rotating contact as the supporting means provides the first roller with continuous movements corresponding to the surface variations of the second roller.

In yet another aspect of the invention, a method of continuously self-aligning a first surface with a second surface comprises the step of providing an assemblage, as described above, for supporting the first surface for movements in proximate rotating contact with the second surface. The first and second surfaces are then rotated while in proximate rotating contact, the second surface typically making rotational and translational movements relative to the first surface. In response to the movements of the second surface, the movements of the first surface are adjusted to correspond with the rotational and translational movements of the second surface hereby enabling continuous alignment and proximate contact between the first and second surfaces.

It is, therefore, an advantageous effect of the present invention that the self-aligning apparatus allows freedom of movement of a first surface, such as a nip roller, relative to a proximate rotating contacting second surface, such as a web roller, so that inmate rotating contact therebetween is maintained despite geometrically imperfections in the second surface.

BRIEF DESCRIPTION OF THE DRAWINGS

The foregoing as well as other objects, features and advantages of this invention will become more apparent from the appended Figures, wherein like reference numerals denote like elements, and wherein.

DETAILED DESCRIPTION OF THE DRAWINGS

Figure 1:
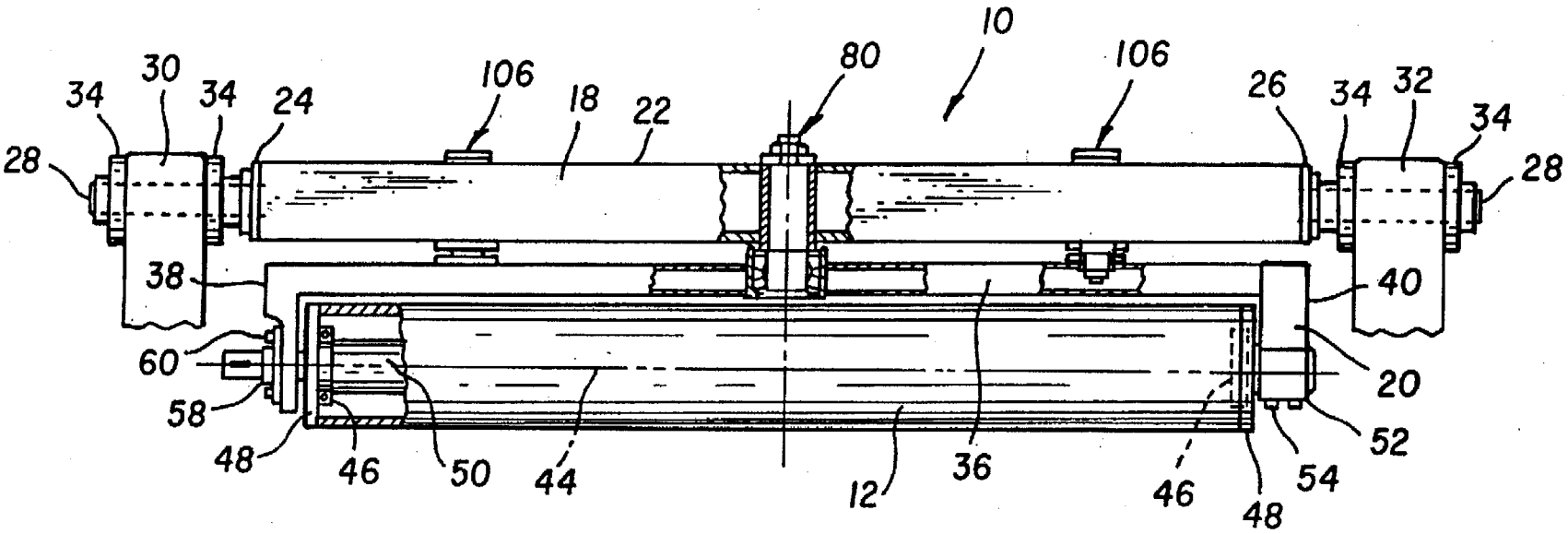
FIG. 1 is a front elevational view of the apparatus of the invention.

Turning now to the drawings, and in particular to FIG. 1, the apparatus 10 in accordance with the principles of the invention for self aligning a first surface 12 with a second surface 14 is illustrated. FIG. 1 depicts an elevational view of apparatus, alternately referred to as serf-aligning pivot frame, 10. According to the invention, self-aligning pivot frame 10 comprises structurally connected first and second frame members 18,20. First frame member 18 comprises main portion 22 and opposed first and second end portions 24,26 arranged on the main portion 22. An elongated shaft 28, defining a central axis, is structurally mounted to the each of the first end portion 24 and second end portion 26. First and second mounting means 30,32 are each supportedly arranged on each shaft 28 using, for instance, conventional flange cartridge bearings 34 or other equivalent mounting method. Mounting means 30, 32 are used to support apparatus 10 in, for instance, a web converting machine (not shown).

Referring again to FIG. 1, second frame member 20, comprises second main portion 36 and opposed third and fourth end portions 38,40 arranged on the main portion 36. End portions 38,40 comprises means for supportedly securing a first surface, preferably a rotatable, generally cylindrical nip roller, 12. In the preferred embodiment, nip roller 12 rotates about a central axis 44 extending between the third and fourth end portions 38,40. Mounting means, as described in details below, is arranged in each end portions 38,40 and provide the structure for rotatably supporting the nip roller 12 about central axis 44 while seated in second frame member 20. At least a circumferential portion 45 (depicted in FIG. 2) of nip roller 12 extends approximately equidistant beyond the end portions 38,40 of the second frame member 20 for proximately contacting a circumferential portion of a second rotating surface 14. Preferably, nip roller 12 is supported at both end portions 38,40 of second frame member 20, and is allowed to rotate about central axis 44 by using roller bearings 46 which are retained with gudgeons 48 mechanically secured to each end of nip roller 12. The roller bearings 46 are mounted on the non-rotating roller shaft 50 which is attached to the second frame member 20 at one end. Preferably, the aforementioned attachment is accomplished with a retaining cap 52 with mounting screws 54 which pass through threaded clearance apertures or holes (not shown) in the retaining cap 52 and threaded into the second frame member 20. The other end of the roller shaft 50 is supported using a standard flange cartridge bearing 58 which is secured to the third end portion 38 of the second frame member 20. Preferably, mounting screws 60 which pass through clearance holes (not shown) in the cartridge bearing 58 and threaded into a threaded portion (not shown) of the third end portion of the second frame member 20 is used to secure cartridge bearing 58 to the second frame member 20.

Figure 2:
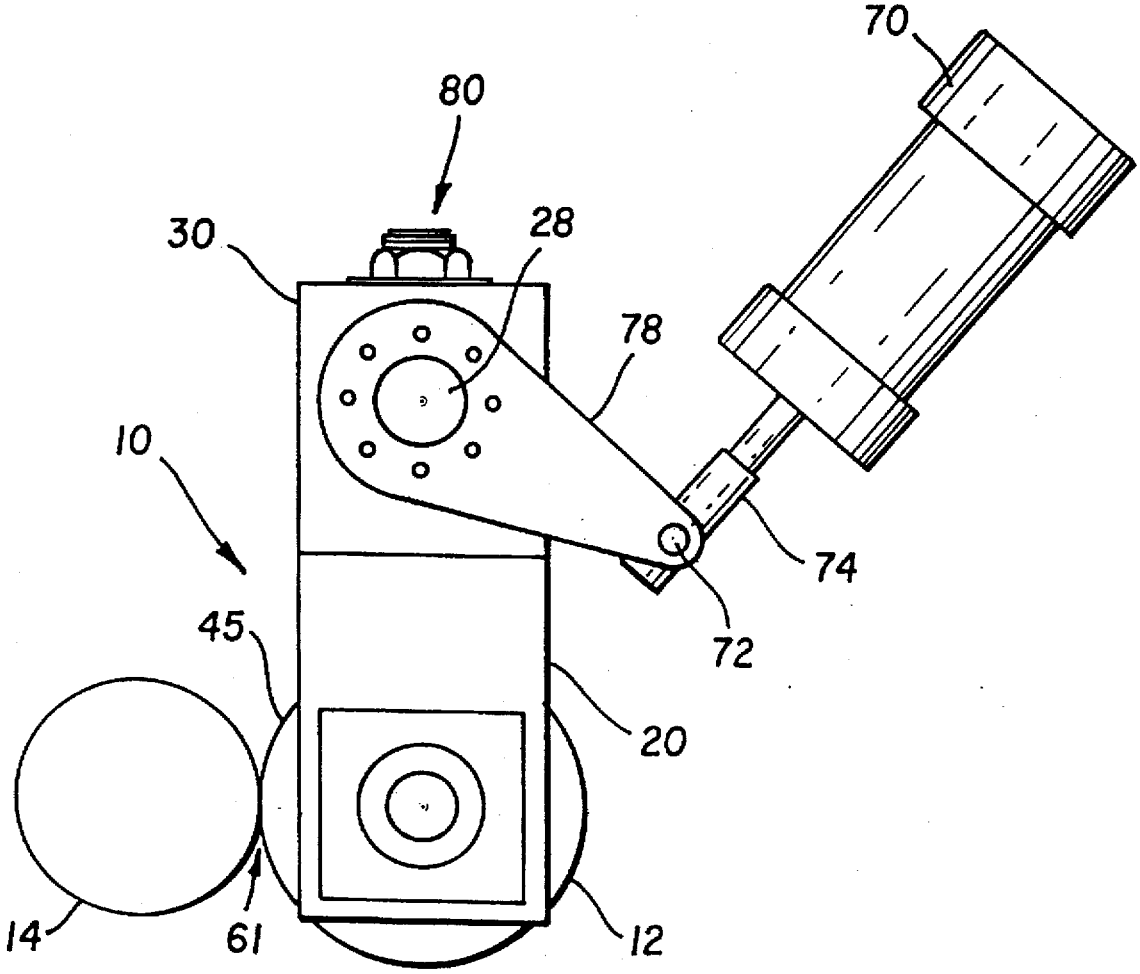
FIG. 2 is an end elevational view of the invention.

In FIG. 2, an end view of the apparatus 10 of the invention is illustrated with the second mounting means 32 shown in FIG. 1 removed for clarity. The extending circumferential portion 45 of the nip roller 12 mounted in the second frame member 20 is arranged to contact and align with a circumferential portion of a second surface, or roller, 14. In the preferred embodiment, second surface 14 may be a rotatable core or spool, winding roll, or web conveyance roller, which forms a nip 61 when the first frame member 18 comprising the first surface or nip roller 12 is rotated about shaft, or central axis, 28 towards and in proximate contact with the second surface or web conveyance roller 14. Application of contact force between the rotating surfaces 12,14 is accomplished by rotating the first frame member 18 towards the second frame member 20 about shafts 28. Shafts 28 define a central axis extending between the first and second end portions 24,26 of the first frame member 18. Preferably, an air or hydraulic cylinder 70, as shown in FIG. 2, is used to accomplish the aforementioned rotation. Skilled artisans will appreciate that other rotating means, such as, electrical drives, or torsion springs coupled to the first frame member 18 at a fixed radial distance from the central axis 28 with a pin 72, and rod clevis or rod end beating 74 could also be used with similar results.

Figure 3:
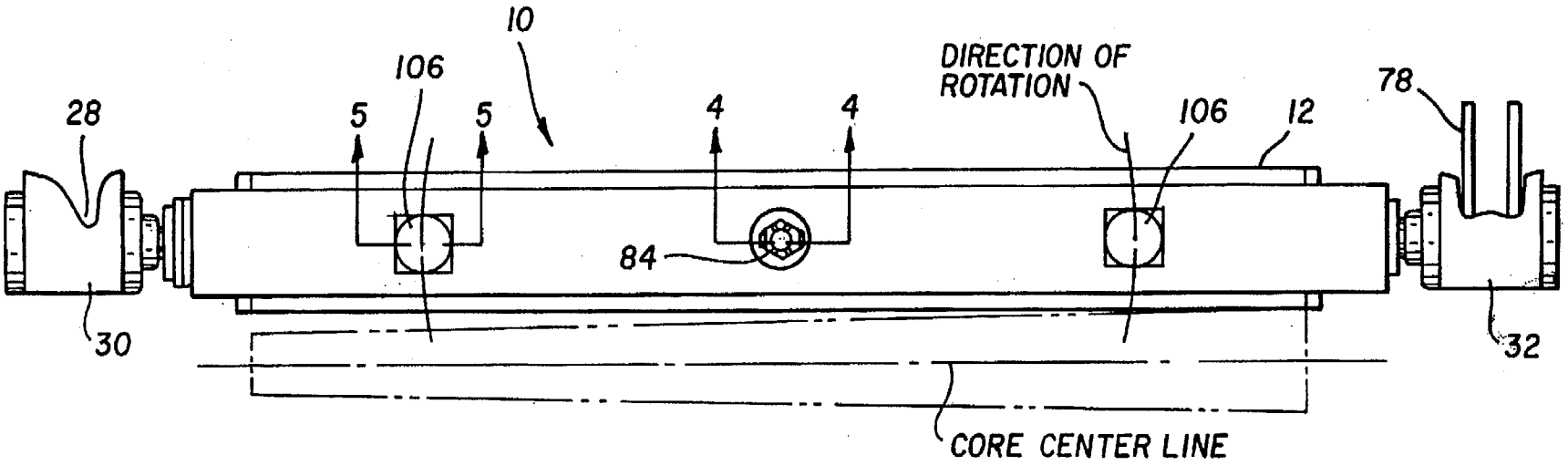
FIG. 3 is a plane view of the invention.

In FIG. 3, a plane view of the apparatus 10 of the invention is illustrated. The rotational degree of freedom of the self-aligning pivot frame 10 is illustrated using a non-cylindrical or tapered core geometry and the direction of rotation, as denoted by the arrows. Preferably, a pivot arm 78 is operably connected to at least one of the shafts 28 which is used to connect both end portions 24,26 of the first frame member 18 to the first and second mounting means 30,32. Pivot arm 78 enables the first frame member 18 containing nip roller 12 to pivot towards and away from the web roller 14. The pivot arm 78 can be driven by pneumatically, electrically or mechanically, each producing substantially similar results.

Figure 4:
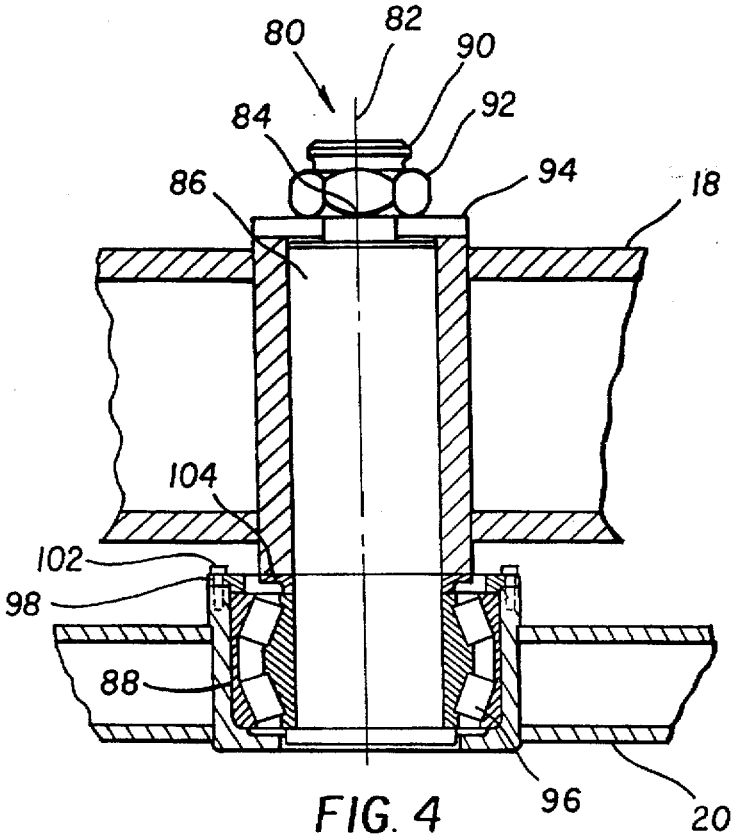
FIG. 4 is a partial cross sectional view along line 4—4 of FIG. 3; and, FIG. 5 is a partial cross sectional view along line 5—5 of FIG. 3.

As depicted in FIG. 4, a central pivot beating 80 is positioned at about the midpoint 82 of the second frame member 20 on an axis extending perpendicular to the shaft or central axis 28 of the first frame member 18. Further, central pivot beating 80 is arranged in the first frame member 18 at about the midpoint 84 of the main portion 22. A pivot shaft 86 extends from the first frame member 18 into a roller bearing bore 88 arranged in the second frame member 20. Pivot shaft 86 comprises a threaded portion 90 which is provided to secure the pivot shaft 86 to the first frame member 18 using, for instance, a hex nut 92 and cap 94. Roller bearing 96 is mounted to the pivot shaft 86 and a beating cap 98 is used to secure the roller bearing 96 in the bearing bore 88 of second frame member 20 using screws 102 which pass through clearance holes in the bearing cap and thread into the second frame member 20. A grind spacer 104 is used to obtain proper fit for securing the roller beating 96 in the bearing bore 88 of the second frame member 20.

Referring again to FIGS. 1 and 3, spaced, similar first end and second end thrust bearings 106 are provided for flexibly connecting the first frame member 18 to the second frame member 20. In the preferred embodiment of the invention, apparatus 10 utilizes two thrust bearings 106, each being mounted equidistant from central pivot beating 80. Thrust bearings 106 provide flexible support for the second frame member 20, which is rotatable about the central pivot bearing 80, as best seen in FIG. 3. Additionally, thrust bearings 106 limit the rotational motion of the second frame member 20 without generating resistance or friction in the direction of rotation, and resist forces applied by web material (not shown) or other machine components.

Figure 5:
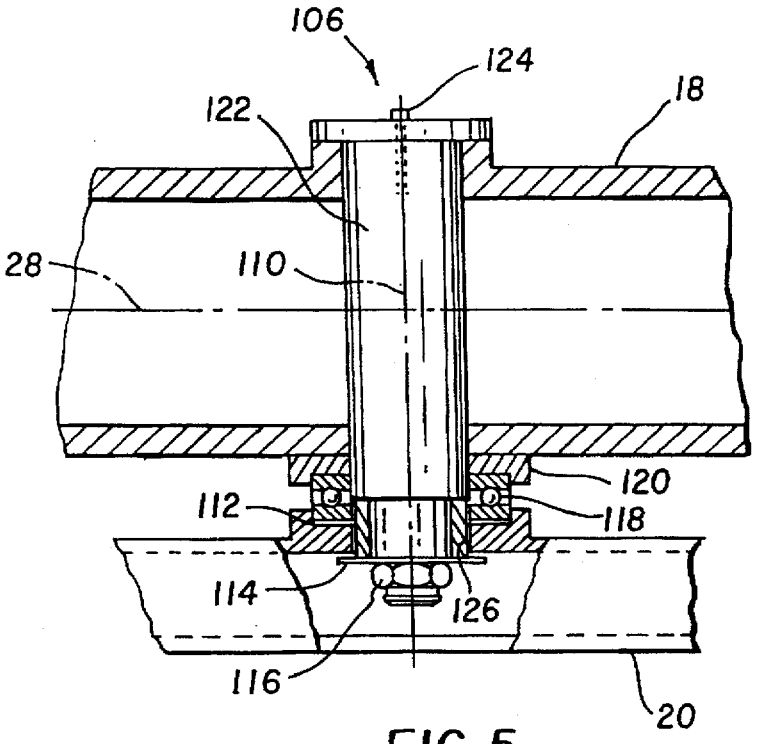

According to FIG. 5, the details of the thrust bearing 106 mounting arrangement is illustrated. One of the pair of first end- and second end-thrust bearings 106 is positioned at about the midpoint between the central pivot bearing 80 and first and second ends of main portion 22 of the first frame member 18. This thrust bearing 106 is arranged in the first frame member 18 on a radial axis 110 that extends substantially perpendicular to the central axis 28 of the first frame member 18 and substantially parallel to the axis of the central pivot beating 108. Further, one of the first end and second end thrust bearings 106 is attached to the second frame member 20 at a position between the midpoint and third end portion 38 of the second frame member 20.

Similarly, the remaining thrust bearing 106 is positioned on the opposite end portion of the lirst frame member 18 approximately midway between the midpoint of the first and second frame members, as defined by the central pivot bearing 80, and the fourth end portion of the second frame member 20. Likewise, the remaining thrust bearing 106 is attached the second frame member 20 approximately between an end portion and midpoint of second frame member 20.

Further, grind spacer 112 is used to obtain proper fit for securing the thrust bearings 106 in the first and second frame members 18,20. Moreover, grind spacer 112 provides alignment of the central axis 44 passing through nip roller 12 mounted in the second frame member 20, with the central axis 28 of the first frame member 18.

Furthermore, washer 114 and mateable hex nut 116 are used to secure the flat seat thrust bearing 118 and cushion 120 on the stop shaft 122 which is attached to the first frame member 18 and extends through the first frame member 18 into the second frame member 20. The stop shaft 122 is secured to the first frame member 18 using, for instance, a screw 124 threaded into the upper end of the stop shaft 122 which defines radial axis 110, which is the central axis of the thrust beating detail 106.

Since the thrust bearings 106 limit rotational movement of the second frame 20, in accordance with the above description, they consequently control the rotational movements of the nip roller 12 to within predetermined limits by providing a clearance between the inside diameter of a bore in the second frame member 20 and outside diameter of the cylindrical cushion 120, which is mounted to the stop shaft 124. Preferably, the amount of rotational movement of the nip roller 12 is controlled by increasing or decreasing clearance between the inside diameter of the boring 126 in the second frame member 20 and outside diameter of the cylindrical cushion 120. Alternatively, rotational movement of nip roller 12 may be controlled by locating the thrust bearings 106 at shorter or longer distances from the central pivot bearing 80.

In operation, the apparatus or self-aligning pivot frame 10 of the invention can be used, for instance, in an automatic roll start process. The ability of the nip roller 12 to maintain intimate contact with the mating circumferential surface of the rotating member 14, in this case a core or spool, is accomplished by providing a rotational degree of freedom with respect to the plane containing the geometrical central axes of the roller 12 and rotating member 14 in surface contact with the nip roller 12. The nip roller 12 can be hard or soft surfaced and vacuum can be applied internally to negatively pressurize the roller surface to improve adhesion between the web and roller periphery. Air or hydraulic cylinders, or any other well understood device, apply pressure to the first frame member 18 and second frame member 20 through the end portions of shaft 28 passing through the first frame member 18 and rotate the assembly toward the core. The nip roller 12 and core surfaces 14 are brought into forced surface contact with one another to generate sufficient contact force to promote adhesion between the web and core, which is prepared using an adhesive tape with exposed adhesive covering a portion of the surface.

In the case of a non-cylindrical core 14, where there exists a diameter difference or taper between ends of the core, the second frame member 20 will pivot about the central pivot bearing 80, shown in FIG. 4 to close the gap created between the core end having a smaller diameter and nip roller 12 to insure line contact exists between the nip roller 12 and core 14 surfaces. A rigid pivot frame design would provide only point contact on the core end having a larger diameter due to its inability to conform to the non-cylindrical core profile. The thrust bearings 106 shown in FIG. 5 support the second frame member 20, minimize deflection, and limit freedom of the second frame member 20 by the spacing between the inside diameter of the bearing bore in the second frame member 20 and outer diameter of the cylindrical cushion 120.

In the case of a non-concentric core, the second frame member 20 pivots about the central pivot bearing 80 shown in FIG. 4 to provide a momentary response to higher frequency oscillations created by the nonconcentricity, thus maintaining uniform contact force between the nip roller 12 and core 14.

As the core surface moves in a direction away from the surface of nip roller 12 due to it concentricity, the nip roller 12 will rotate about the central pivot bearing 108 in response to the non-concentric surface and maintain uniform contact between the core 14 and nip roller 12. The self-aligning pivot frame 10 separates effects of high inertia caused by heavy mass and supporting members from the fast response necessary to follow higher frequency oscillations caused by differences in distance between the geometrical central axis of a the cylindrical core and its axis of rotation.

One of ordinary skill in the an will appreciate that the apparatus 10 of the invention can be used for other types of automatic roll start processes, where a nip roller 12 is rotated into forced contact with a core or spool, 14, to maintain uniform nip roller contact force by compensating for non-concentricity and noncylindricity in core geometry. A vacuum roller (not shown), which has vacuum applied internally to pressurize the roller surface negatively and improve contact between said roller surface and web, can be used in this application.

Further, the apparatus 10 described above can be used for conveyance nip roller 12 applications to maintain uniform contact force and prevent web imperfections by compensating for widthwise web caliper variations.

Furthermore, apparatus 10 can be used as a low cost enhancement to rigid pivoting lay-on roller designs, where a lay-on roller is rotated into surface contact with a winding roll of web material, to compensate for non-cylindricity (taper) in winding roll diameter caused by widthwise web thickness variations and wound roll non-concentricity or runout.

| Parts List | |
|---|---|
| 10 | apparatus or self aligning frame |
| 12 | first surface or nip roller |
| 14 | second surface or core or roller or web roll |
| 18 | first frame member |
| 20 | second frame member |
| 22 | main portion |
| 24 | first end portion |
| 26 | second end portion |
| 28 | shaft or central axis |
| 30 | first mounting means |
| 31 | first end portion |
| 32 | second mounting means |
| 33 | second end portion |
| 34 | flange cartridge bearing |
| 36 | second main portion |
| 38 | third end portion |
| 40 | fourth end portion |
| 42 | roller |
| 44 | central axis of nip roller |
| 45 | circumferential portion |
| 46 | roller bearings |
| 48 | gudgeons |
| 50 | roller shaft |
| 52 | retaining cap |
| 54 | mounting screws |
| 58 | standard flange cartridge bearing |
| 60 | mounting screws |
| 61 | nip |
| 62 | cartridge bearing |
| 70 | air or hydraulic cylinders |
| 72 | pin |
| 74 | rod clevis or rod end bearing |
| 78 | pivot arm |
| 80 | central pivot bearing |
| 82 | midpoint of second frame member |
| 84 | midpoint of first frame member |
| 86 | pivot shaft |
| 88 | roller bearing bore |
| 90 | threaded portion |
| 92 | hex nut |
| 94 | cap |
| 96 | roller bearing |
| 98 | bearing cap |
| 100 | bearing bore |
| 102 | screws |
| 104 | grind spacer |
| 106 | thrust bearing or detail |
| 110 | radial axis |
| 112 | grind spacer |
| 114 | washer |
| 116 | mateable hex nut |
| 118 | flat seat thrust bearing |
| 120 | cylindrical cushionable layer |
| 122 | stop shaft |
| 124 | screw |
| 126 | inside bore diameter |

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

We claim:

1. Apparatus for self-aligning a first roller in proximate contact with a second, roller comprising:

a first frame member having a main portion and first and second opposite end portions structurally mounted to said main portion, first and second elongated members structurally mounted to a respective first and second opposite end portion, said first and second elongated members defining a central axis passing through said first frame member, and said first and second opposite end portions being capable of rotation about said central axis;

a second frame member having second, opposite end portions for supporting said first roller; and first end bearing means, central pivot bearing means, and second end bearing means for supportedly mounting the first frame member to said second frame member, said bearing means being arranged so as to enable either of said first end bearing means and second end bearing means to apply continuous pressure to said second frame member in response to movements of said second roller thereby providing continuous alignment of said first roller with said second roller; wherein a pivot shaft having a threaded and non-threaded end portion is disposed in said central pivot bearing means and passes through a boring in said second frame member, said threaded end portion extending outwardly of said first frame member, and wherein a hex nut and cap are arranged on said threaded end portion of said pivot shaft to secure the pivot shaft to said first and second frame members, and wherein said non-threaded end portion of said pivot shaft is disposed in a roller bearing arranged in said boring in said second frame member, said roller bearing being secured to said pivot shaft by a bearing cap.

2. The apparatus recited in claim 1, wherein said first and second rollers are generally cylindrical.

3. The apparatus recited in claim 1, wherein said first end bearing means and second end bearing means each comprises a thrust bearing for providing flexible mounting support between said first and said second frame members.

4. The apparatus recited in claim 3, wherein end of said thrust bearing is arranged on a radial axis that extends substantially perpendicular to said central pivot axis of the first frame member.

5. The apparatus recited in claim 3, wherein each of said thrust bearing is structurally arranged along said first frame member at a location substantially midway between said central pivot bearing means and either of said first and second opposite end portions of said first frame member.

6. The apparatus recited in claim 3, wherein a grind spacer is arranged between each said first end bearing means and second end bearing means and said second frame member.

7. The apparatus recited in claim 3, wherein a stop shaft is disposed in each said first end bearing means and second end bearing means for securing said first frame member to each of said bearing means, said stop shaft being secured to said first frame member by a screw threadably extending between said stop and said first frame member.

8. The apparatus recited in claim 7, wherein a cushionable layer is arranged circumferentially about a portion of said stop shaft and disposed at least partially in said boring in said second frame member.

9. The apparatus recited in claim 8, wherein a clearance is provided between the insider diameter of said boring in said second frame member and the outside diameter of said cushionable layer, said clearance providing freedom of rotation of said second frame member about said central pivot bearing.

10. The apparatus recited in claim 1, wherein a pivot arm is structually connected to each said first and second opposite end portions of said first frame member.

11. The apparatus recited in claim 1, wherein means are provided for simultaneously rotating said first and second frame member and said first roller mounted in said second frame member into proximate, alignable rotating contact with said second roller.

12. The apparatus recited in claim 11, wherein said rotating means comprises a pneumatic or hydraulic cylinder cooperating with said first frame member.

13. Self-aligning roller assemblage, comprising:

a first frame member;

a second frame member mounted to said first frame member, said second frame member having first and second end portions arranged thereon for rotatably supporting a first roller;

a second roller positioned in alignable, proximate rotating contact with said first roller;

bearing means arranged in said first and second frame members to provide continuous movements of said first roller relative to movements of said second roller, said bearing means comprising a first end bearing, a second end bearing and a central pivot bearing, and wherein a pivot shaft having a threaded and non-threaded end portion is disposed in said central pivot bearing and passes through a boring in said second frame member, said threaded end portion extending outwardly of said first frame member, and wherein a hex nut and cap are arranged on said threaded end portion of said pivot shaft to secure the pivot shaft to said first and second frame members, and wherein said non-threaded end portion of said pivot shaft is disposed in a roller bearing arranged in said boring in said second frame member, said roller bearing being secured to said pivot shaft by a bearing cap.

14. A method continuously self-aligning a first surface with a second surface, comprising the steps of:

providing an assemblage having a first and second frame member for supporting said first roller in proximate contact with said second roller;

providing a first end bearing means, a central pivot bearing means and a second end bearing means on said assemblage for adjusting the movements of said first roller in response to movements of said second roller, wherein a pivot shaft having a threaded and non-threaded end portion is disposed in said central pivot bearing means and passes through a boring in said second frame member, said threaded end portion extending outwardly of said first frame member, and wherein a hex nut and cap are arranged on said threaded end portion of said pivot shaft to secure the pivot shaft to said first and second frame members, and wherein said non-threaded end portion of said pivot shaft is disposed in a roller bearing being secured to said pivot shaft by a bearing cap;

rotating said first and second rollers, said second roller making rotational and translational movements relative to said first roller; and adjusting the movements of said first roller to correspond with said rotational and translational movements of said second roller thereby enabling continuous alignment of said first roller with said second roller.

* * * * *